US006908345B2

(12) United States Patent
Shimizu et al.

(10) Patent No.: US 6,908,345 B2
(45) Date of Patent: Jun. 21, 2005

(54) ELECTRIC CONNECTOR AND SOCKET CONNECTOR

(75) Inventors: Kazuomi Shimizu, Aichi (JP); Shoichi Sasaki, Aichi (JP)

(73) Assignee: J.S.T. Mfg. Co., LTD, Osaka (JP)

( * ) Notice: Subject to any disclaimer, the term of this patent is extended or adjusted under 35 U.S.C. 154(b) by 141 days.

(21) Appl. No.: 10/332,311

(22) PCT Filed: Jul. 12, 2001

(86) PCT No.: PCT/JP01/06034

§ 371 (c)(1),
(2), (4) Date: Jan. 8, 2003

(87) PCT Pub. No.: WO02/07268

PCT Pub. Date: Jan. 24, 2002

(65) Prior Publication Data

US 2004/0002265 A1 Jan. 1, 2004

(30) Foreign Application Priority Data

Jul. 14, 2000 (JP) ..... 2000-214782

(51) Int. Cl.[7] ..... H01R 24/00
(52) U.S. Cl. ..... 439/682; 439/342
(58) Field of Search ..... 439/259, 342, 439/376, 682

(56) References Cited

FOREIGN PATENT DOCUMENTS

| | | | |
|---|---|---|---|
| EP | 0 142 952 | A2 | 5/1985 |
| JP | 40-2941 | B | 2/1965 |
| JP | 58-93181 | A | 6/1983 |
| JP | 63-218174 | A | 9/1988 |
| JP | 06-29014 | U | 4/1994 |
| JP | 06-163107 | A | 6/1994 |

OTHER PUBLICATIONS

English Translation of International Preliminary Examination Report for application PCT/JP01/06034 dated Jun. 12, 2002.

*Primary Examiner*—Khiem Nguyen
(74) *Attorney, Agent, or Firm*—Rader, Fishman & Grauer PLLC

(57) ABSTRACT

An electric connector, comprising a base connector (4) fixed onto a mounting surface (3) and a socket connector (6) extracted from the inserting space (5) of the base connector (4) along the extracting direction (X2) generally orthogonal to the mounting surface (3), wherein, when an electric conductor (7) extending in the direction parallel with the mounting surface (3)(Y) is pulled in the direction parallel with the mounting surface (3)(Y), a tension is converted into a force in the direction of extracting the socket connector (6) (X2) by the activation of the cam surface (24) of the base connector (4) and the cam surface (37) of the socket connector (6), whereby the socket connector (6) can be removed smoothly.

18 Claims, 11 Drawing Sheets

ELECTRIC CONNECTOR AND SOCKET CONNECTOR

TECHNICAL FIELD

The present invention relates to an electric connector including, for example, a base connector fixed onto a surface of a base and a socket connector extractable from the base connector along a direction orthogonal to the base, as well as to the socket connector.

BACKGROUND ART

The recent years have seen a dramatic proliferation of cellular phones and PHS (Personal Handyphone System). In the case of the cellular phone and the like, a user having purchased a device needs to mount a connector of an integral battery to a connector of a base or the like. Furthermore, when the life of the battery expires, the user usually replaces it with a new one.

Thus, the connector is mounted or removed by such a user who is not accustomed to the handling of the connectors. There may be a case where an inadequate connection between contacts results from an inadequate coupling between the connectors. If an excessive force is applied to extract the socket connector, the contact or the base may be damaged.

On the other hand, there is a demand for a connector having a low profile when mounted. A top-type connector assembly wherein the socket connector is extracted upward from the base connector generally has a great height of the whole connector bodies because electric wires are also located at an upper portion of the assembly.

A side-type connector assembly wherein the socket connector is extracted laterally from the base connector can achieve the reduction of the height of the whole connector bodies because the electric wires also extend laterally. However, it is practically difficult to laterally extract the socket connector in a state where the connector assembly is incorporated into a device.

In this connection, an increasing number of cellular phones employ a system wherein the socket connector is extracted upward whereas the wires extend laterally. The system is a so-called compromise between the above types of connector assemblies.

In the compromise system, however, the socket connector is difficult to extract because the direction of extracting the socket connector differs from the direction in which the wires extend. Furthermore, there is a fear of damaging both the connectors by forcibly extracting the socket connector.

DISCLOSURE OF THE INVENTION

A preferred embodiment of the invention for achieving the above object comprises a base connector including a base housing defining an inserting space accommodating a plurality of contacts, and fixed onto a mounting surface; and a socket connector including a socket housing accommodating a plurality of contacts, and an electric conductor extending from the socket housing in a direction generally parallel with the mounting surface. When removed from the base connector, the socket connector is extracted from the inserting space of the base connector along a predetermined extracting direction generally orthogonal to the mounting surface. The base connector and socket connector each include a cam surface, the cam surfaces capable of matching with each other. The cam surfaces serve to convert an extracting force on the socket connector into a force directed in the predetermined extracting direction, the extracting force applied via the electric conductor to the socket connector in the direction generally parallel with the mounting surface when the socket connector is removed from the base connector.

According to the embodiment of the invention, if the electric conductor is pulled to extract the socket connector, a force component acting generally parallel with the mounting surface can be converted into the force directed in the predetermined extracting direction by means of the cam surfaces. Accordingly, the socket connector may be smoothly extracted without causing an excessive load on both the connectors. When, on the other hand, the socket connector is mounted in place, the corresponding cam surfaces function to guide insertion of the socket connector thereby ensuring a reliable mounting of the socket connector.

BEST MODE FOR CARRYING OUT THE INVENTION

A preferred embodiment of the invention will be described with reference to the accompanying drawings.

Figure 1:
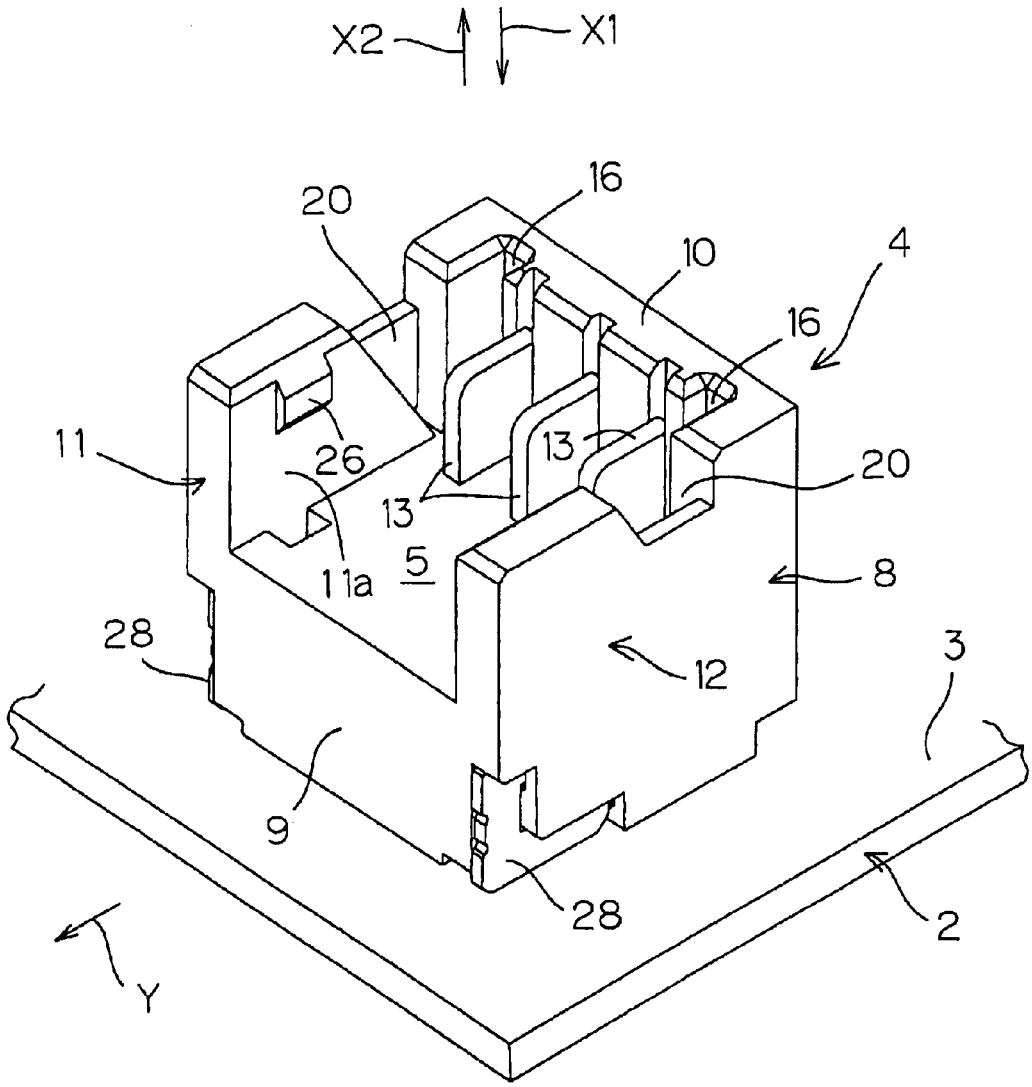
FIG. 1 is a schematic perspective view showing a base connector of an electric connector according to one embodiment of the invention.
Figure 2:
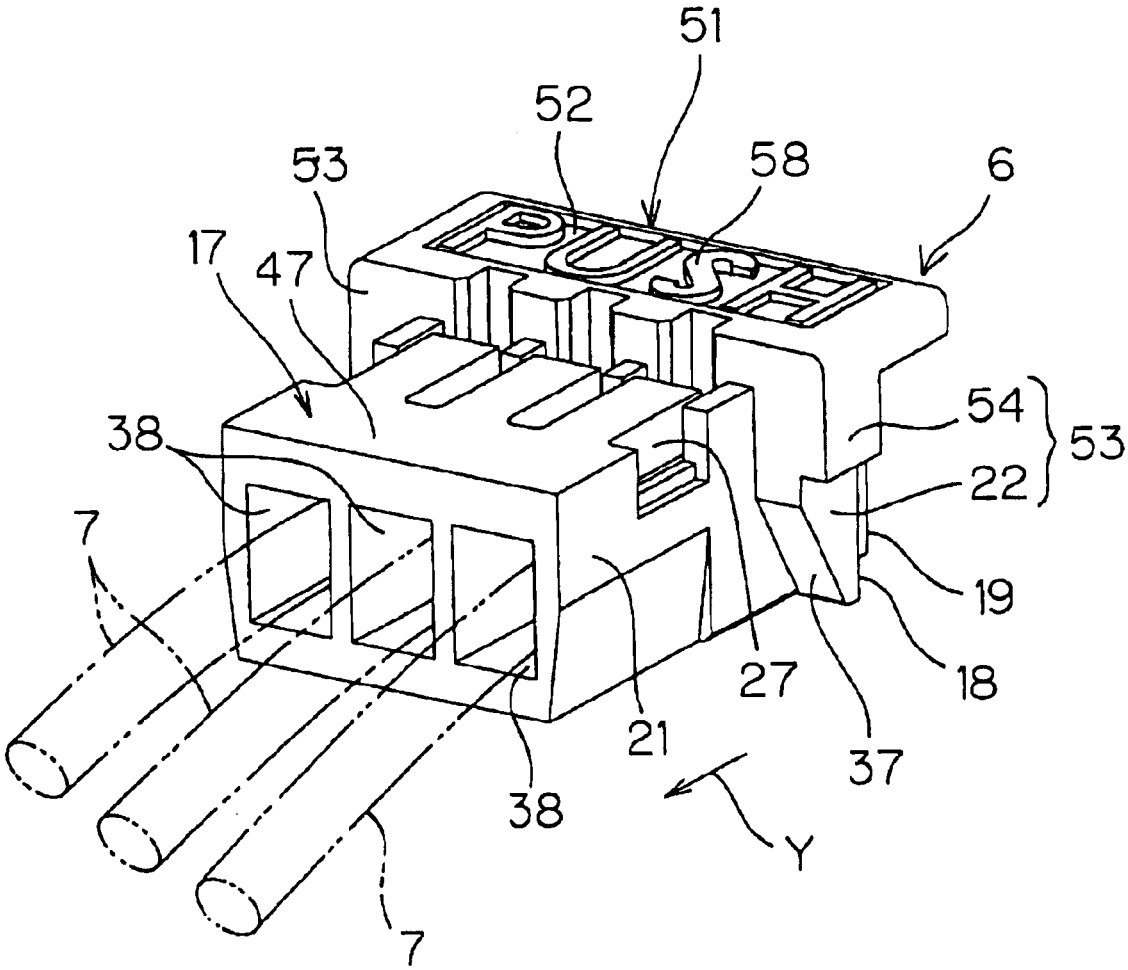
FIG. 2 is a schematic perspective view showing a socket connector of the electric connector.
Figure 10:
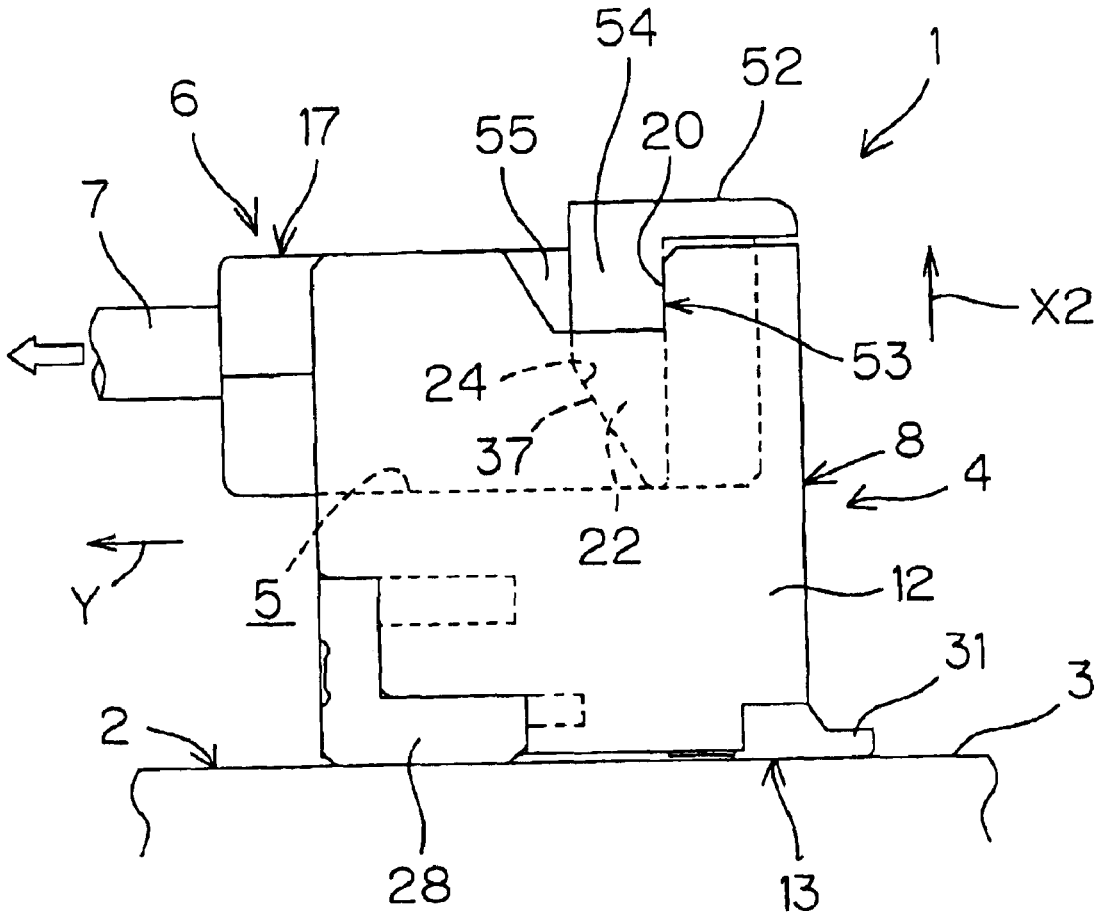
FIG. 10 is a side view showing the connectors in perfect connection.

FIGS. 1 and 2 are schematic perspective views showing a base connector and a socket connector included in an electric connector according to one embodiment of the invention. FIG. 10 is a side view showing the electric connector wherein both the connectors are in connection. Referring to these figures, the electric connector 1 includes a base connector 4 fixedly soldered onto a mounting surface 3 of a base 2, and a socket connector 6 forming a pair with the base connector 4 and inserted in or extracted from an inserting space 5 of the base connector 4. The electric connector 1 is used for connection between a base such as of a cellular phone, PHS or the like and a battery.

Referring to FIGS. 1 and 2, the inserting space 5 of the base connector 4 opens along a direction orthogonal to and away from the mounting surface 3 of the base 2 (the direction representing a direction X2 for extracting the socket connector 6) as well as along a forward direction Y which is parallel with the mounting surface 3.

The socket connector 6 is inserted into the inserting space 5 of the base connector 4 along an inserting direction X1 orthogonal to the mounting surface 3, and is extracted from the inserting space 5 along the extracting direction X2 orthogonal to the mounting surface 3. The socket connector 6 includes leads 7, as an electric conductor, generally extending in the forward direction Y.

When the socket connector 6 is removed from the base connector 4, the leads 7 may sometimes be pulled along a direction other than the extracting direction X2. However, the embodiment of the invention has a primary feature that when the leads are pulled along a direction other than the extracting direction, the tension via the leads 7 is converted into a force directed in the direction X2 for extracting the socket connector 6 such that the socket connector 6 may be smoothly extracted without causing twist.

Figure 3:
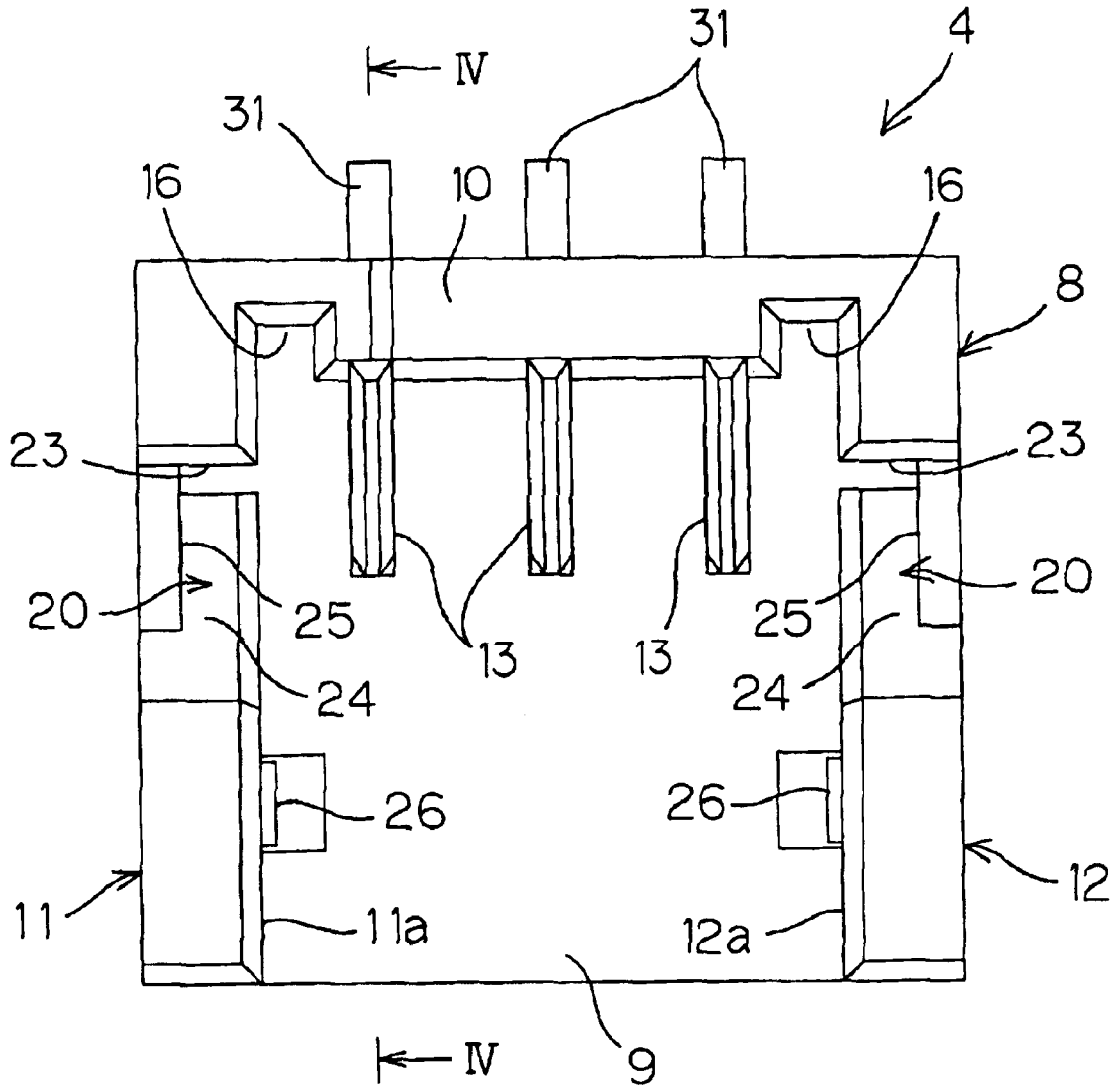
FIG. 3 is a plan view showing the base connector.
Figure 4:
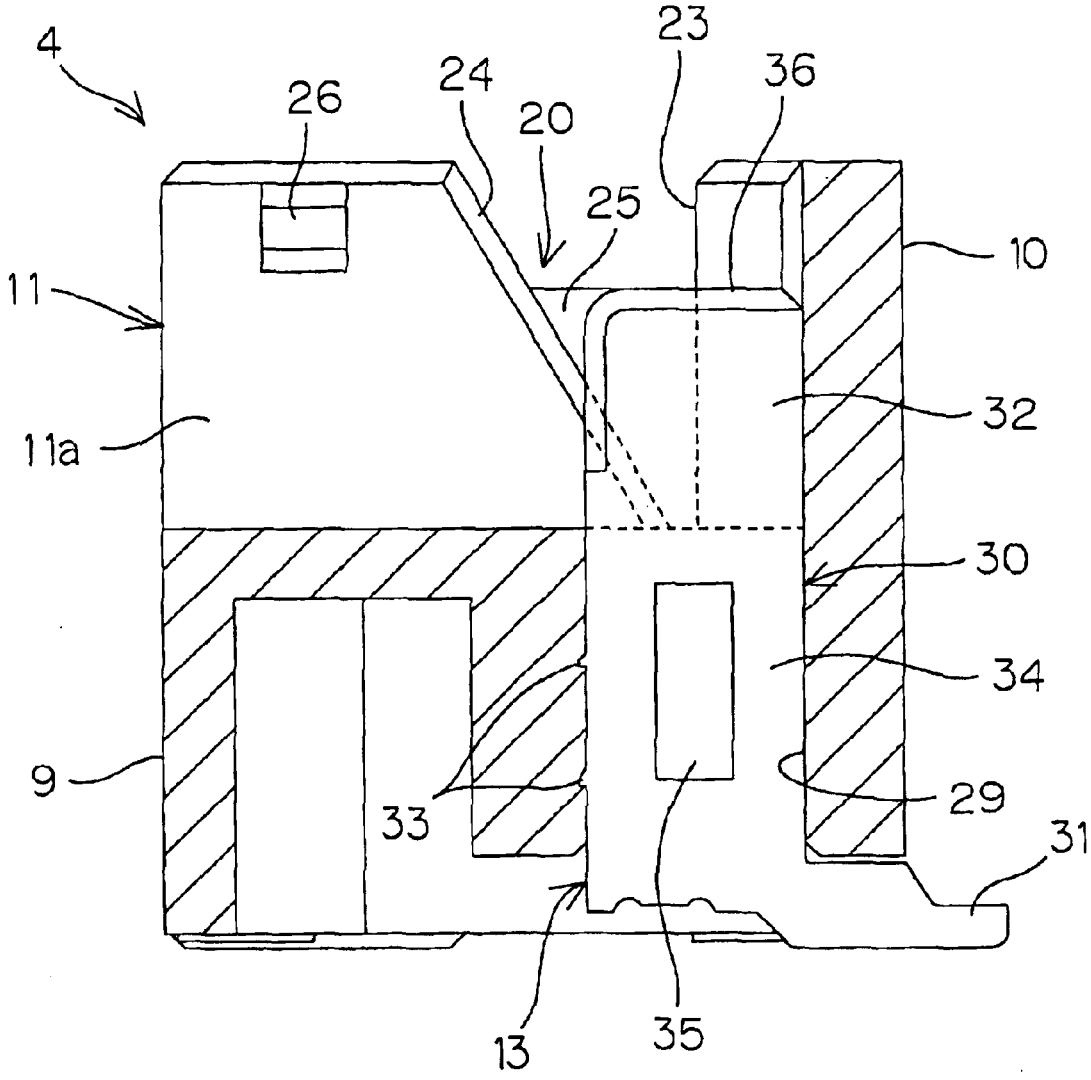
FIG. 4 is a sectional view taken on the line IV—IV in FIG. 3, omitting the hatching for representing the sections of a contact.

FIG. 3 is a plan view showing the base connector 4 whereas FIG. 4 is a sectional view taken on the line IV—IV in FIG. 3. Referring to FIGS. 1, 3 and 4, the base connector 4 includes a base housing 8, which includes a base 9 fixed onto the mounting surface 3, a rear wall 10 and a pair of lateral side walls 11, 12 which upstand from the base 9. The inserting space 5 is defined by the rear wall 10 and the lateral side walls 11, 12.

The inserting space 5 accommodates a plurality of plate-like contacts 13 (three contacts, for example) disposed in parallel with the side walls 11, 12. Referring to FIG. 4, each contact 13 is retained by the base 9 and the rear wall 10 as inserted in a corresponding fixing hole 29 formed in the base 9. The contact 13 includes a body portion 30 generally of a rectangular shape, and a lead portion 31 extending rearwardly from a lower end of the body portion 30. The body portion 30 includes a contact portion 32 projecting upward from the base 9, and a fixable portion 34 having press-insertion projections 33 press-inserted in the fixing hole 29. A reference numeral 35 represents a through hole formed in the fixable portion 34 in correspondence to the press-insertion projections 33. A reference numeral 36 represents a chamfer which is formed at an upper edge and a front edge of the contact portion 32 for facilitating the connection with a corresponding contact 14 of the socket connector 6.

Figure 8:
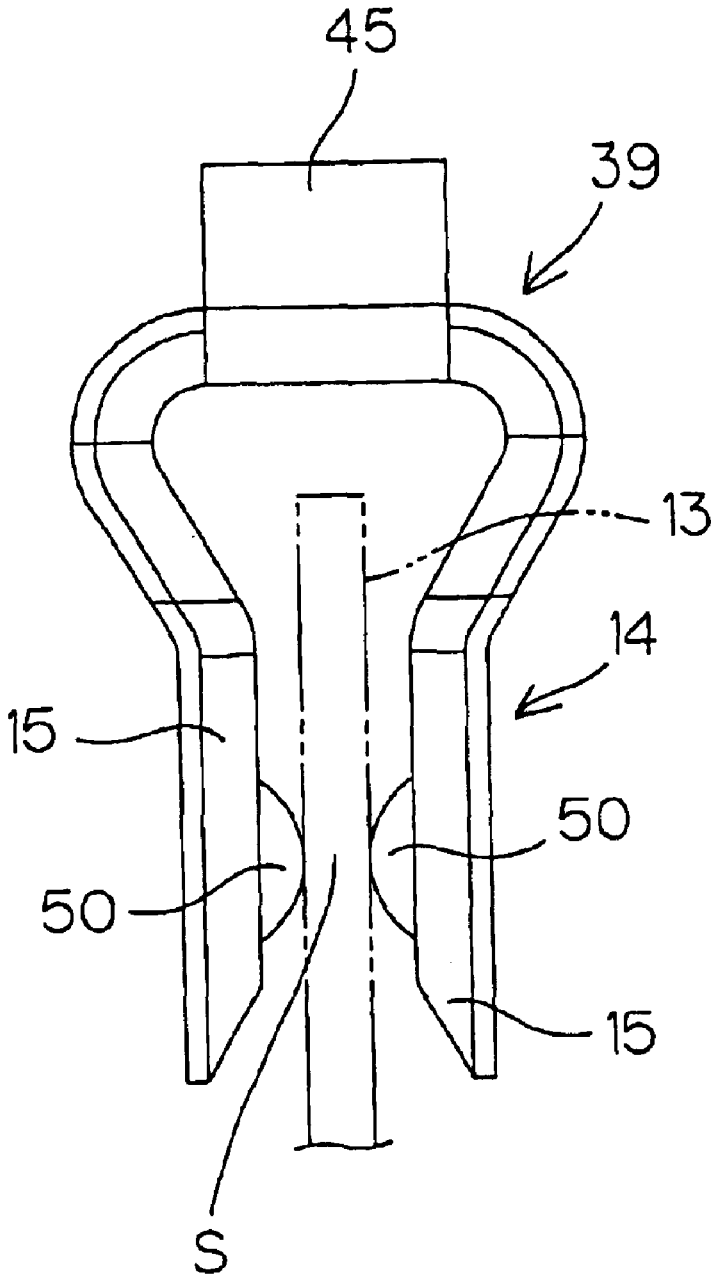
FIG. 8 is a front view showing a terminal.
Figure 9:
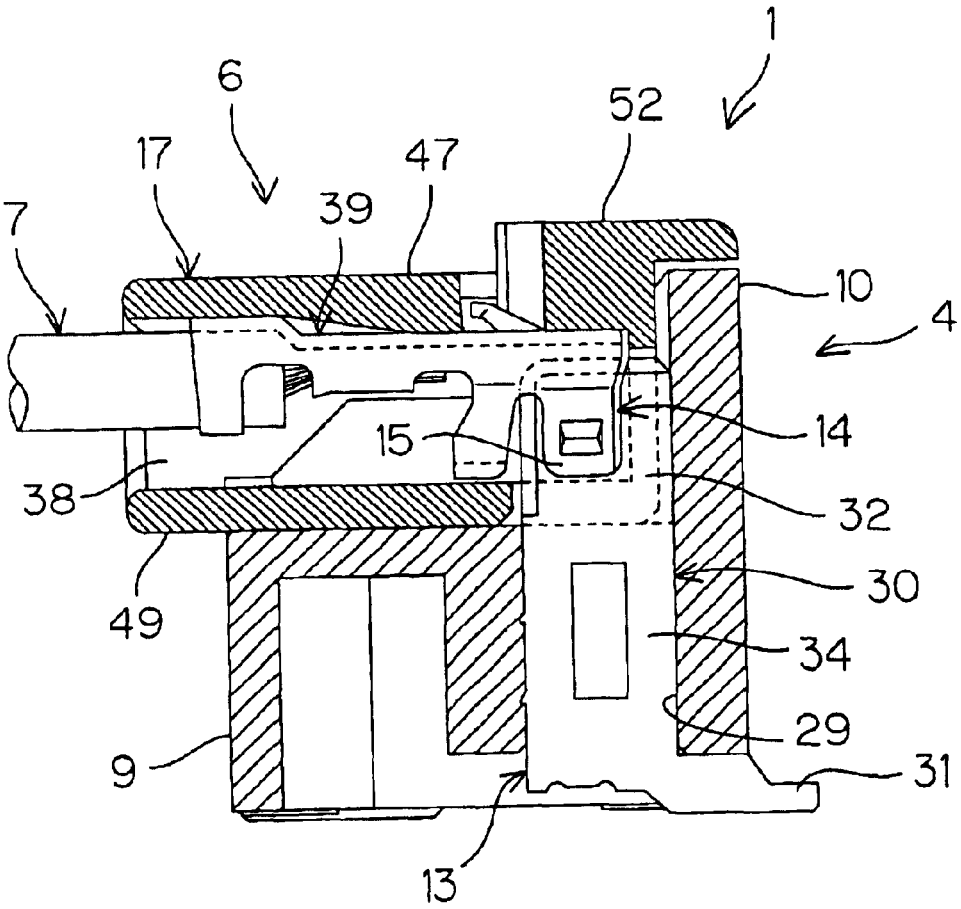
FIG. 9 is a sectional view showing the connectors in connection, omitting the hatching for representing the sections of the terminal and contact.

Each of the contacts 13 is arranged such that when the connectors 4, 6 are in connection, the contact 13 is retained as clamped between a pair of contact pieces 15 of a corresponding contact 14 of the socket connector 6 (see FIG. 8).

Referring to FIGS. 1 and 3, the rear wall 10 is formed with vertical grooves 16 which extend in line with corresponding side walls 11, 12. The vertical grooves 16 are adapted to fittingly receive corresponding vertical ribs 19 (see FIG. 6) on an end face 18 of the socket housing 17 when the connectors 4, 6 are in connection.

Referring to FIGS. 1, 3 and 4, the side walls 11, 12 are formed with fitting grooves 20 on respective inside surfaces 11*a*, 12*a* thereof, the fitting groove 20 extended vertically and located laterally of the contact 13. The fitting grooves 20 are adapted to mate with corresponding two-step ribs 53 (see FIGS. 2 and 6) formed on lateral sides 21 of the socket housing 17. The two-step rib 53 includes an upper rib 54 of a greater thickness and a lower rib 22 of a smaller thickness.

Referring to FIGS. 1 and 3, each fitting groove 20 is shaped like an inverted triangle, progressively decreased in width toward bottom. The fitting groove 20 is defined by an inside rear wall 23 extended vertically, a cam surface 24 formed by an inside front wall extended angularly with respect to the vertical direction, and a groove bottom surface 25. A portion of the groove bottom surface 25 that corresponds to an upper portion of the fitting groove 20 is dispensed with, so that an interior of the fitting groove 20 opens toward a lateral side of the base housing 8.

Returning to FIG. 2, the lower rib 22 of the socket connector 6 has a cam surface 37 defining a slope of an equal inclination to that of the cam surface 24 of the base connector 4. With the lower rib 22 fitted in the fitting groove 20 of the base connector 4, the cam surface 37 of the lower rib 22 matches with the cam surface 24 of the fitting groove 20, so that a tension via the leads 7 along the forward direction Y of the base connector 4, for example, is converted into a force directed in the direction X2 of extracting the socket connector 6.

Referring to FIGS. 1, 3 and 4, the inside surfaces 11*a*, 12*a* of the side walls 11, 12 are each formed with a fitting projection 26 at a front-side upper place thereof. When the connectors 4, 6 are in connection, the fitting projections 26 fit in corresponding fitting recesses 27 in the lateral sides 21 (see FIG. 2) of the socket housing 17 whereby the connection between the connectors is retained by a predetermined holding force.

Returning to FIG. 1, a reference numeral 28 represents a reinforcing tab as a metallic reinforcing member, which is press-inserted in a press-insertion groove formed at each lower front portion of the base housing 8 while having one part thereof exposed from each corresponding lateral side of the base housing 8 so as to be soldered to an electric conductive portion of the surface 3 of the base 2.

Figure 5:
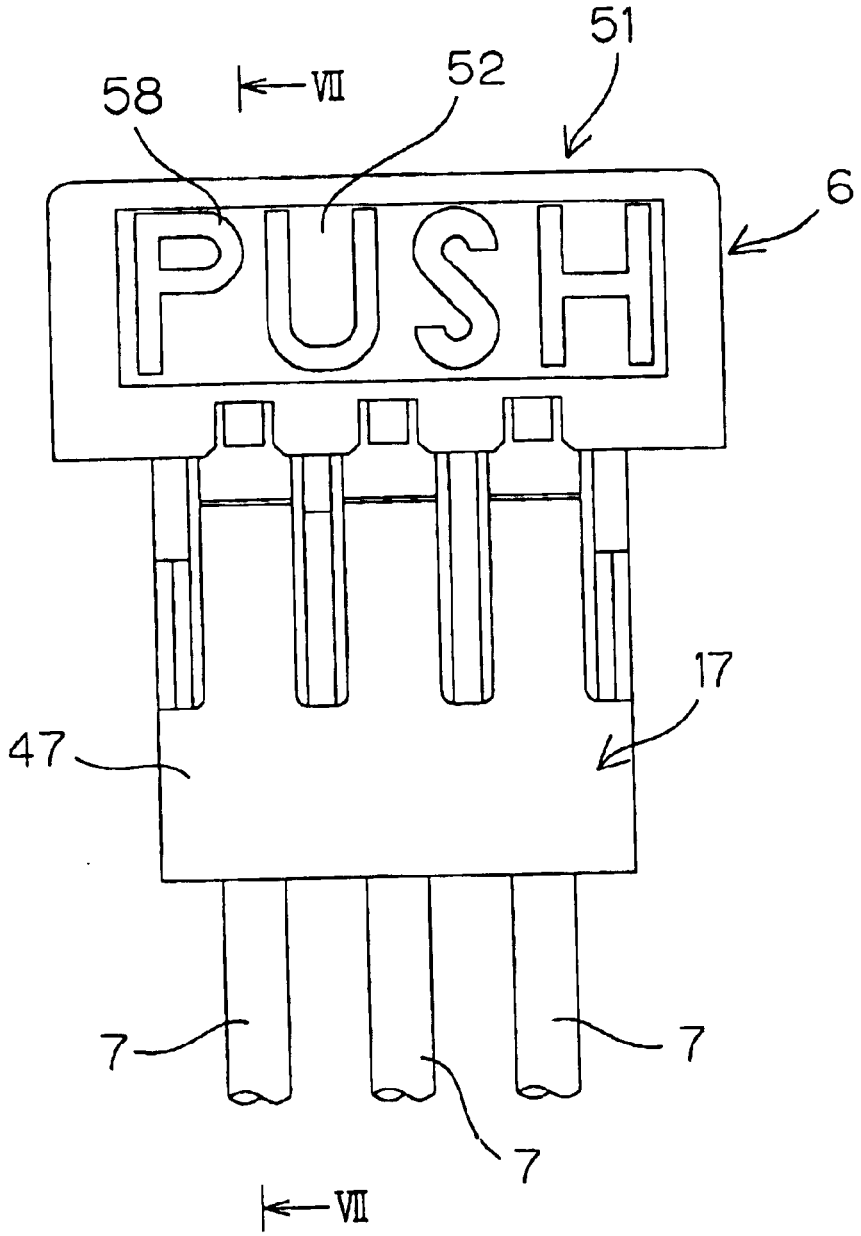
FIG. 5 is a plan view showing the socket connector.
Figure 6:
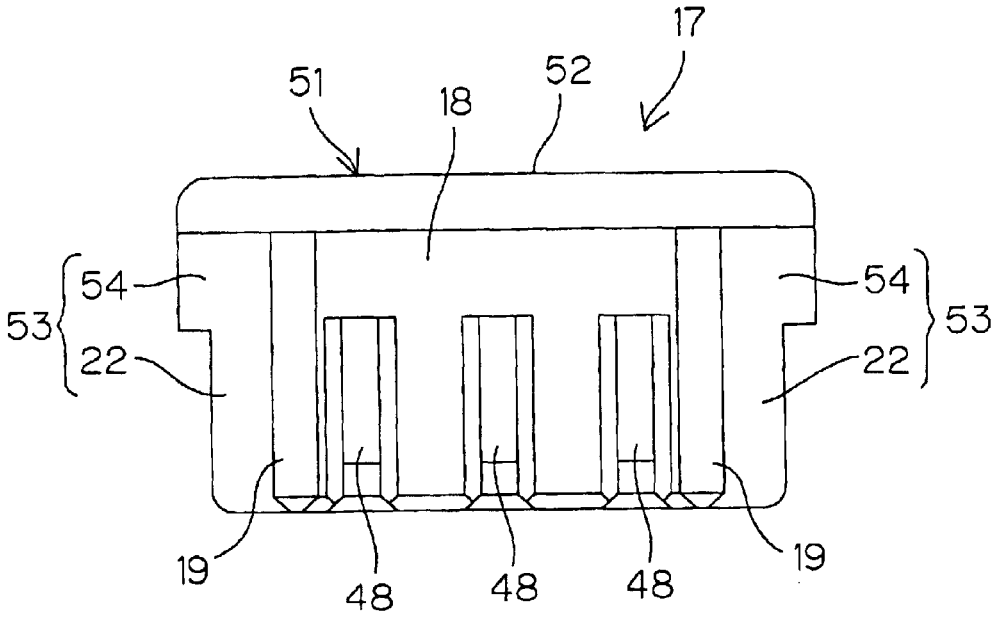
FIG. 6 is a front view showing a socket housing.
Figure 7:
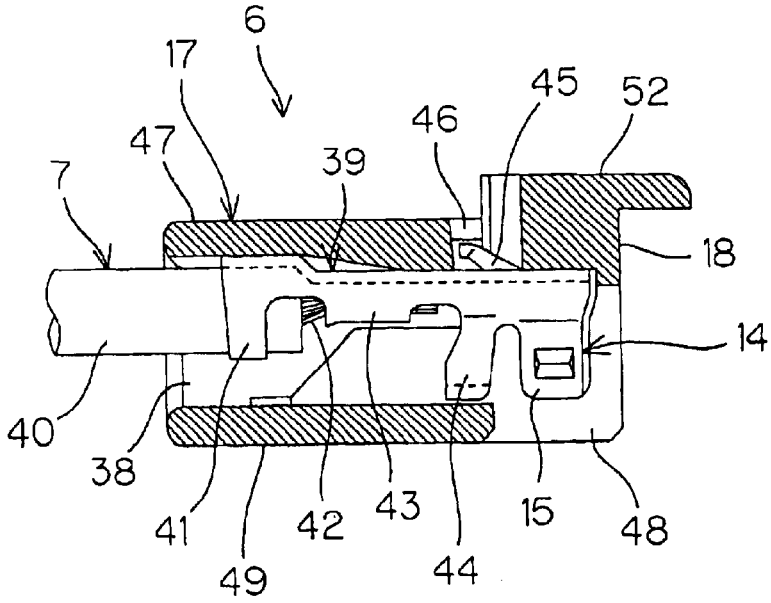
FIG. 7 is a sectional view taken on the line VII—VII in FIG. 5.

Returning to FIG. 2, the socket connector 6 includes the socket housing 17 generally shaped like a rectangular parallelpiped. The socket housing 17 includes a plurality of terminal receiving holes 38 which are extended along an anteroposterior direction and laterally arranged. FIG. 5 is a plan view of the socket connector whereas FIG. 6 is an end elevation of the housing of the socket connector. FIG. 7 is a sectional view taken on the line VII—VII in FIG. 5.

Referring to FIG. 7, each of the terminal receiving holes 38 accommodates a terminal 39 crimped onto an end of each lead 7. The terminal 39 includes an insulation barrel 41 crimped onto a jacket 40 of the lead 7, a wire barrel 43 crimped onto a conductor 42 of the lead 7, a box 44 shaped like a square ring to be fitted in an inside surface of the terminal receiving hole 38, and the contact 14 having the aforesaid pair of contact pieces 15.

A reference numeral 45 represents a lance comprising a resilient projection which engages a corresponding engagement hole 46 of the socket housing 17 for preventing the disengagement of the terminal 39 from the terminal receiving hole 38. The engagement hole 46 opens into a top surface 47 of the socket housing 17 so that an engaging state of the lance 45 can be visually inspected from above. Each of the terminal receiving holes 38 defines an elongate slit 48 (see FIGS. 6 and 7), which opens to the forward end face 18 and a forward bottom surface 49 of the socket housing 17. Each slit 48 accommodates a corresponding contact 14.

Now referring to FIG. 8 showing a front view of the terminal 39, the contact 14 includes a pair of contact pieces 15 extended parallel with each other in opposed relation. The contact pieces 15 are each provided with a contact portion 50 on their opposite surfaces, the contact portions projecting toward each other. Each of the plate-like contacts 13 (represented by the two-dot-dash line in FIG. 8) of the base connector 4 is inserted in a gap S between the pair of opposite contact portions 50, so that the contact 13 is resiliently retained as clamped between the pair of contact pieces 15, 15 for ensuring contact pressure between the contacts 13, 14.

Returning to FIG. 2, the socket housing 17 is formed with a frame 51 at a front portion thereof, the frame generally forming a groove opening downwardly as viewed from the front side as shown in FIG. 6. The frame 51 includes a protrusion 52 protruded relative to the top surface 47 of the socket housing 17 serving as a pressure surface and corresponding to the position of the contacts 14, and the aforesaid pair of two-step ribs 53 projecting from the respective lateral sides 21 of the socket housing 17. As shown in FIGS. 2 and 5, a rib-like mark 58, for example, is provided on a surface of the protrusion 52 for indicating that a portion carrying the mark should be pressed for mounting the socket connector 6.

As shown in FIG. 10, the lower rib 22 of the two-step rib 53 fits in a lower portion (where the groove bottom portion 25 exists) of the fitting groove 20 of the base connector 4, whereas the upper rib 54 is received by an upper portion (where the groove bottom portion 25 does not exist) of the fitting groove 20. The coupling via the two-step ribs 53 ensures that the housings 8, 17 of the connectors 4, 6 are firmly connected together.

In a state where the two-step ribs 53 are fitted in the fitting grooves 20 to bring the cam surfaces 37 of the lower ribs 22 into the matching relation with the corresponding cam surfaces 24, relieves 55 shaped like an inverted triangle are defined between the upper ribs 54 and the cam surfaces 24 of the fitting grooves 20.

The embodiment of the invention is designed based on the combination of the top-type connector assembly with the side-type connector assembly having the leads 7 extended horizontally, thereby achieving a low profile of the connectors mounted on the base. Furthermore, the embodiment is arranged such that when the leads 7 are pulled along a direction other than the extracting direction X2 in order to extract the socket connector 6, a component of the tension that acts generally parallel with the surface 3 of the base 2 can be converted into a force directed in the extracting direction X2 by virtue of the cam surfaces 37, 24. Therefore, the socket connector 6 may be smoothly extracted without subjecting the connectors 4, 6 to an excessive load. The cam surfaces 37, 24, in particular, are positioned laterally of the group of contacts 13, 14 and hence, the cam surfaces 37, 24 provide the converted force directed in the extracting direction X2 which is applied to places on the opposite sides of the group of contacts 13, 14 and relatively close thereto. This results in a smoother extraction of the socket connector 6.

When, on the other hand, the socket connector 6 is mounted in place, the cam surfaces 24, 37 function to guide the insertion of the socket connector 6 thereby ensuring a reliable mounting of the socket connector 6.

The inserting space 5 of the base connector 4 opens both in the upward extracting direction X2 and the forward direction Y, so that the socket connector 4 inserted in the inserting space 5 is confined by the side walls 11, 12 while being allowed of a degree of freedom of movement with respect the above two directions. On the other hand, the plate-like contact 13 positioned parallel with the side walls 11, 12 is retained as clamped between the pair of contact pieces 15, 15 of the corresponding contact 14. Therefore, the socket connector 6 may be moved in either directions of the free movement without twisting the contacts 13, 14.

Figure 11:
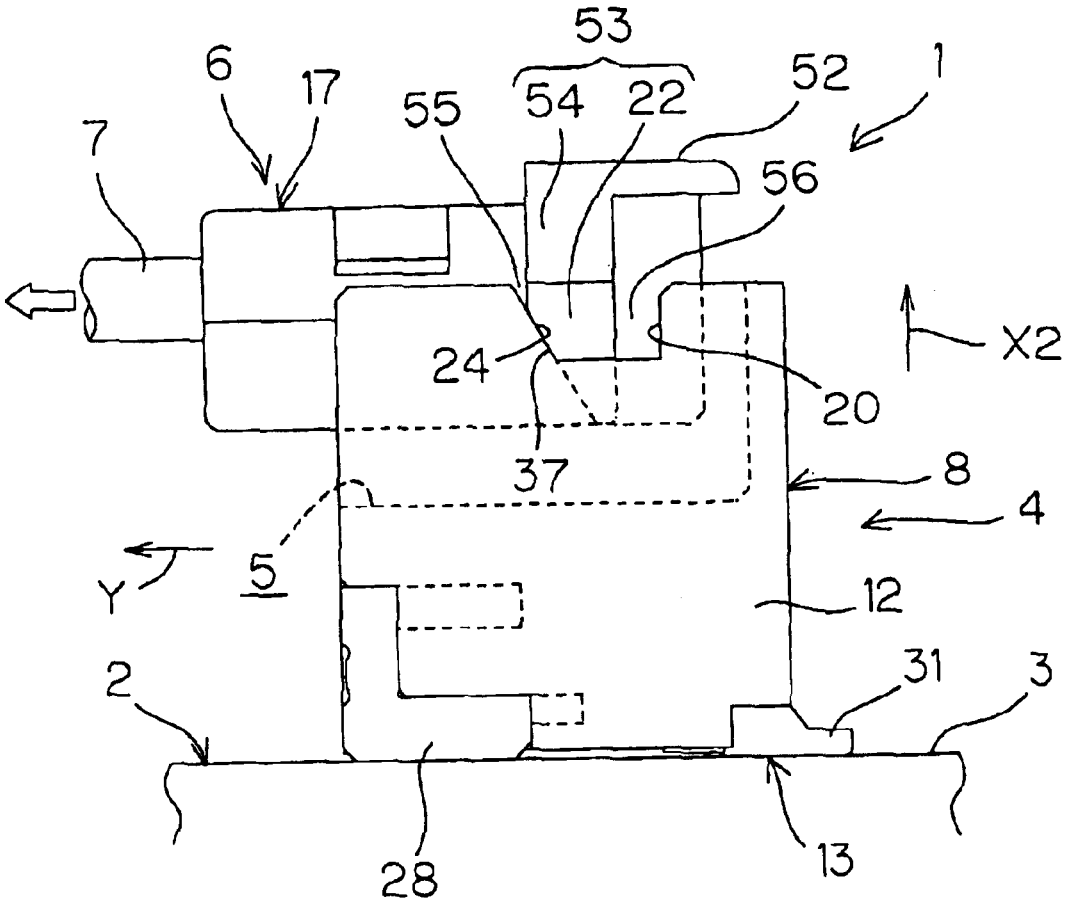
FIG. 11 is a side view of the connectors showing a process where a forward extracting force applied via a lead is converted into a force directed in an extracting direction X2 for extracting the socket connector.

If the socket connector 6 in perfect connection with the connector 4, as shown in FIG. 10, is moved a little along the extracting direction X2, the relieves 55, 56 are formed on the opposite sides of the lower rib 22, as shown in FIG. 11, so as to increase the freedom of movement of the socket housing 17. As a result, it becomes easier to extract the socket connector 6.

The rear wall 10 and the lateral side walls 11, 12 of the base connector 4 define a section of an open-ended square, while the side walls 11, 12 are coupled with the socket connector 6 via the two-step ribs 53. Hence, a part of the connector housing 8 is combined with a part of the connector housing 17 via the two-step ribs 53 to form a box structure, which is effective to prevent the twisting of the housings 8, 17 which may cause an unwanted load on the contacts 13, 14.

Further, the top surface 47 serving as a pressure surface to be pushed with a finger for inserting the socket connector 6 into the inserting space 5 has the protrusion 52 in correspondence to the position of the contacts 14. Thus, whenever the socket connector 6 is mounted in place, the protrusion 52 is depressed strong enough to ensure the positive connection between the contacts 13, 14.

Figure 12:
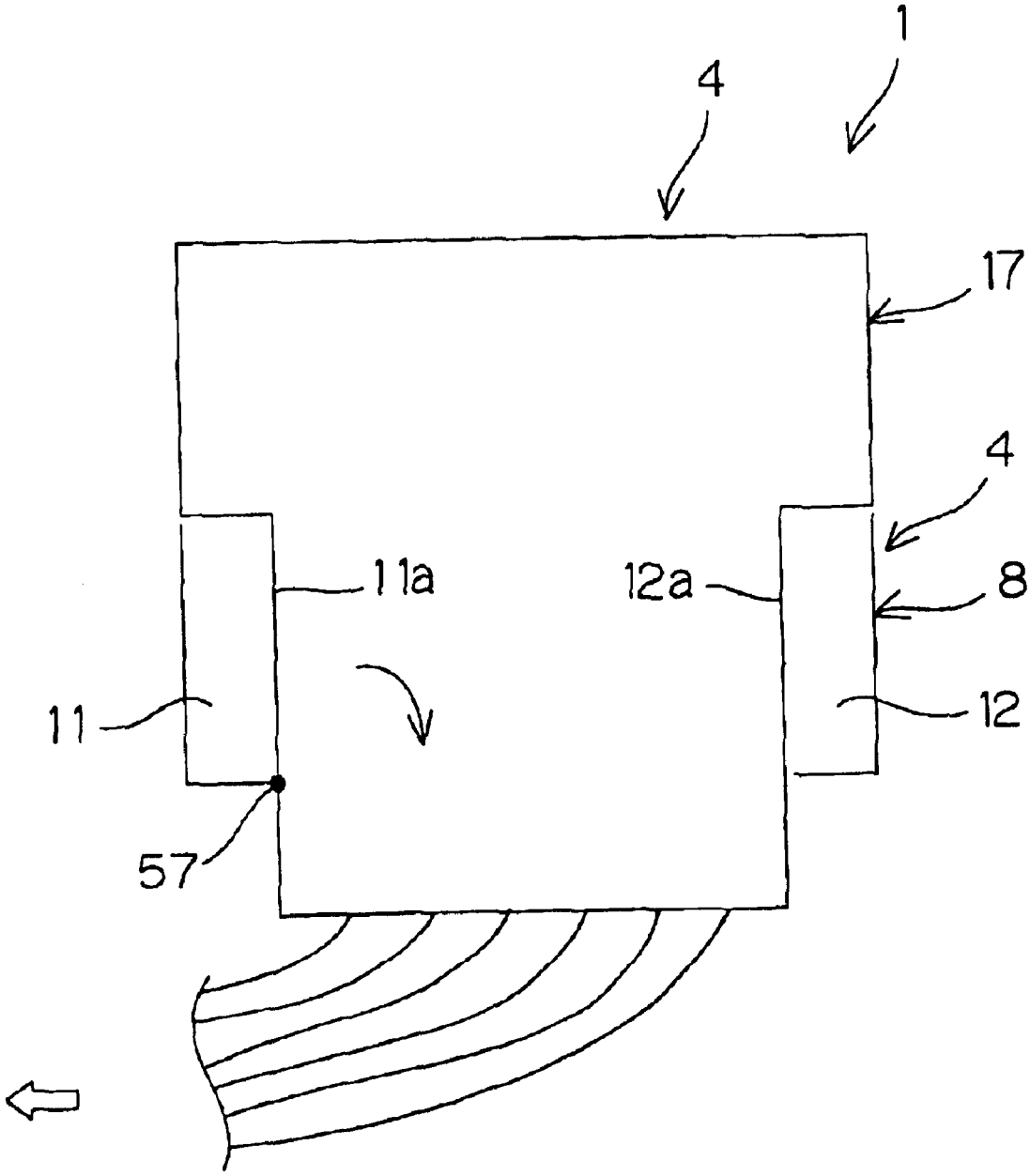
FIG. 12 is a schematic plan view of the connectors showing a state where the extracting force applied via the lead acts laterally of the socket connector.

As shown in FIG. 10, a part of the socket housing 17 projects from the side walls 11, 12 of the base housing 8 along the direction in which the leads 7 extend. Hence, if the leads 7 are pulled along a lateral direction of the socket housing 17 as seen in FIG. 10 (or a direction perpendicular to a longitudinal direction of the drawing surface), the socket connector 6 may be extracted easily. This is because, as shown in the schematic diagram of FIG. 12, the tension produces a moment of turning the socket housing 17 about a front edge 57 of the side wall 11 (or 12) of the base housing 8, the moment converted by the pair of cam surfaces 24, 37 on the opposite side into the force acting in the extracting direction X2.

Although the above embodiment has the arrangement wherein the socket connector is attached to the leads from a battery, the invention is not limited to this. The socket connector may be applied to any of the common repair parts that may be handled by users.

The electric conductor connected with the socket connector may include a solid wire, multi-core cables, flexible printed circuits such as called FPCs, flexible flat cables and the like. Other various changes and modifications may be made within the scope of the invention.

What is claimed is:

1. An electric connector comprising;

a base connector including a base housing defining an inserting space accommodating a plurality of contacts, and fixed onto a mounting surface; and a socket connector including a socket housing accommodating a plurality of contacts, and an electric conductor extending from the socket housing in a direction generally parallel with the mounting surface, wherein when removed from the base connector, the socket connector is extracted from the inserting space of the base connector along a predetermined extracting direction generally orthogonal to the mounting surface, the base connector and socket connector individually including a cam surface, the cam surfaces capable of matching with each other, the cam surfaces serving to convert an extracting force on the electric conductor into a force directed in the predetermined extracting direction, the extracting force applied via the electric conductor to the socket connector in a direction generally parallel with the mounting surface when the socket connector is removed from the base connector such that, as the socket connector is extracted from the base connector, the socket connector moves in an inclined manner simultaneously away from the mounting surface and in the direction of the extracting force.

2. An electric connector as claimed in claim 1, wherein the base housing includes a base fixed onto the mounting surface, and a rear wall and a pair of lateral side walls upstanding from the base, and wherein the inserting space is defined by the base, rear wall and lateral side walls and opens along the extracting direction and the direction in which the electric conductor extends.

3. An electric connector as claimed in claim 2, wherein the contacts in the base connector are each shaped like a plate parallel with the side wall and retained by the rear wall and the base, and wherein the contacts in the socket connector each include a pair of contact pieces capable of retaining a corresponding contact of the base connector in a manner to clamp the contact therebetween.

4. An electric connector comprising:

a base connector including a base housing defining an inserting space accommodating a plurality of contacts, and fixed onto a mounting surface; and a socket connector including a socket housing accommodating a plurality of contacts, and an electric conductor extending from the socket housing in a direction generally parallel with the mounting surface, wherein when removed from the base connector, the socket connector is extracted from the inserting space of the base connector along a predetermined extracting direction generally orthogonal to the mounting surface, the base connector and socket connector individually including a cam surface, the cam surfaces capable of matching with each other, the cam surfaces serving to convert an extracting force on the socket connector into a force directed in the predetermined extracting direction, the extracting force applied via the electric conductor to the socket connector in the direction generally parallel with the mounting surface when the socket connector is removed from the base connector, wherein the base housing includes a base fixed onto the mounting surface, and a rear wall and a pair of lateral side walls upstanding from the base, wherein the inserting space is defined by the base, rear wall and lateral side walls and opens along the extracting direction and the direction in which the electric conductor extends, wherein a pair of lateral sides of the socket housing are each provided with a rib, wherein the lateral side walls of the base housing are each formed with a fitting recess capable of mating with a corresponding rib, and wherein the cam surface of the socket connector is formed at the rib whereas the cam surface of the base connector is formed at the fitting recess.

5. An electric connector as claimed in claim 4, wherein a side face of each rib defines plural steps.

6. An electric connector as claimed in claim 4, wherein each filling recess is shaped like an inverted triangle progressively decreased in width toward the mounting surface.

7. An electric connector as claimed in claim 4, wherein when the fitting recess is mated with a corresponding rib, a relief expanding along the predetermined extracting direction is formed between the fitting recess and the rib.

8. An electric connector as claimed in claim 2 or 3, wherein with the socket connector coupled with the base connector, a part of the socket housing projects from the side walls of the base housing in the direction in which the electric conductor extends.

9. An electric connector as claimed in claim 2 or 3, wherein the cam surfaces of the base connector are provided at the lateral side walls of the base housing to be positioned laterally of the contacts in the base connector.

10. An electric connector as claimed in any one of claims 1 to 3, wherein the socket housing has a pressure surface to be pushed with a finger when the socket connector is inserted into the inserting space, the pressure surface having a protrusion in correspondence to the position of the contacts in the socket connector.

11. A socket connector extractable from an inserting space of a base connector fixed onto a mounting surface along a predetermined extracting direction generally orthogonal to the mounting surface, the socket connector comprising:

a socket housing for accommodating a plurality of contacts;

an electric conductor extending from the socket housing in a direction generally parallel with the mounting surface; and a cam surface for converting an extracting force into a force directed in the predetermined extracting direction, the extracting force applied via the electric conductor in a direction generally parallel with the mounting surface such that, as the socket connector is extracted from the base connector, the socket connector moves in an inclined manner simultaneously away from the mounting surface and in the direction of the extracting force.

12. A socket connector extractable from an inserting space of a base connector fixed onto a mounting surface along a predetermined extracting direction generally orthogonal to the mounting surface, the socket connector comprising:

a socket housing for accommodating a plurality of contacts;

an electric conductor extending from the socket housing in a direction generally parallel with the mounting surface; and a cam surface for converting an extracting force into a force directed in the predetermined extracting direction, the extracting force applied via the electric conductor in the direction generally parallel with the mounting surface, wherein a pair of lateral sides of the socket housing are each formed with a rib having the cam surface.

13. A socket connector as claimed in claim 12, wherein a side face of the rib defines plural steps.

14. A socket connector as claimed in any one of claims 11 to 13, wherein the socket housing has a pressure surface to be pushed with a finger when the socket connector is inserted into the inserting space, the pressure surface having a protrusion in correspondence to the position of the contacts in the socket connector.

15. An electric connector comprising:

a base connector including a base housing defining an inserting space accommodating a plurality of contacts, and fixed onto a mounting surface; and a socket connector including a socket housing accommodating a plurality of contacts, and an electric conductor extending from the socket housing in a direction generally parallel with the mounting surface, wherein when removed from the base connector, the socket connector is extracted from the inserting space of the base connector along a predetermined extracting direction generally orthogonal to the mounting surface, the base connector and socket connector individually including a cam surface, the cam surfaces capable of matching with each other, the cam surfaces serving to convert an extracting force on the socket connector into a force directed in the predetermined extracting direction, the extracting force applied via the electric conductor to the socket connector in the direction generally parallel with the mounting surface when the socket connector is removed from the base connector, wherein the contacts in the base connector are each shaped like a plate parallel with the side wall and retained by the rear wall and the base, wherein the contacts in the socket connector each include a pair of contact pieces capable of retaining a corresponding contact of the base connector in a manner to clamp the contact therebetween, wherein a pair of lateral sides of the socket housing are each provided with a rib, wherein the lateral side walls of the base housing are each formed with a fitting recess capable of mating with a corresponding rib, and wherein the cam surface of the socket connector is formed at the rib whereas the cam surface of the base connector is formed at the fitting recess.

16. An electric connector comprising:

a base connector including a base housing defining an inserting space accommodating a plurality of contacts, and fixed onto a mounting surface; and a socket connector including a socket housing accommodating a plurality of contacts, and an electric conductor extending from the socket housing in a direction generally parallel with the mounting surface, wherein when removed from the base connector, the socket connector is extracted from the inserting space of the base connector along a predetermined extracting direction generally orthogonal to the mounting surface, the base connector and socket connector individually including a cam surface, the cam surfaces capable of matching with each other, the cam surfaces serving to convert an extracting force on the socket connector into a force directed in the predetermined extracting direction, the extracting force applied via the electric conductor to the socket connector in the direction generally parallel with the mounting surface when the socket connector is removed from the base connector, wherein the socket housing has a pressure surface to be pushed with a finger when the socket connector is inserted into the inserting space, the pressure surface having a protrusion in correspondence to the position of the contacts in the socket connector.

17. An electric connector as claimed in claim 16, wherein the base housing includes a base fixed onto the mounting surface, and a rear wall and a pair of lateral side walls upstanding from the base, and wherein the inserting space is defined by the base, rear wall and lateral side walls and opens along the extracting direction and the direction in which the electric conductor extends.

18. An electric connector as claimed in claim 17, wherein the contacts in the base connector are each shaped like a plate parallel with the side wall and retained by the rear wall and the base, and wherein the contacts in the socket connector each include a pair of contact pieces capable of retaining a corresponding contact of the base connector in a manner to clamp the contact therebetween.

* * * * *